US005343126A

United States Patent [19]

Farrall et al.

[11] Patent Number: 5,343,126

[45] Date of Patent: Aug. 30, 1994

[54] EXCITATION COIL FOR AN ELECTRODELESS FLUORESCENT LAMP

[75] Inventors: George A. Farrall, Rexford; John P. Cocoma, Clifton Park; Joseph C. Borowiec, Schenectady; Robert F. Pashley, Ballston Spa, all of N.Y.

[73] Assignee: General Electric Company, Schenectady, N.Y.

[21] Appl. No.: 966,494

[22] Filed: Oct. 26, 1992

[51] Int. Cl.[5] ..... H01J 61/54

[52] U.S. Cl. ..... 315/248; 315/348; 315/39; 313/155; 313/355

[58] Field of Search ..... 315/34, 39, 248, 344, 315/267, 283, 348; 313/155, 355

[56] References Cited

U.S. PATENT DOCUMENTS

| | | | |
|---|---|---|---|
| 2,282,097 | 5/1942 | Taylor | 313/355 X |
| 3,161,540 | 12/1964 | Kingsley et al. | 313/355 X |
| 3,268,305 | 8/1966 | Hagadorn et al. | 313/355 X |
| 4,010,400 | 3/1977 | Hollister | 315/39 X |
| 4,119,889 | 10/1978 | Hollister | 315/39 X |
| 4,422,017 | 12/1983 | Denneman et al. | 315/248 |

FOREIGN PATENT DOCUMENTS

| | | | |
|---|---|---|---|
| 4487 | 1/1979 | Japan | 315/248 |

OTHER PUBLICATIONS

Roberts, "Electrodeless Fluorescent Lamp", pending U.S. patent application, Ser. No. 07/937,083, filed Aug. 31, 1992.

El-Hamamsy, "Electrodeless Fluorescent Lamp Shield for Reduction of Electromagnetic Interference and Dielectric Losses", pending U.S. patent application, Ser. No. 07/936,495, filed Aug. 28, 1992.

*Primary Examiner*—Benny Lee

*Attorney, Agent, or Firm*—Jill M. Breedlove; Marvin Snyder

[57] ABSTRACT

An excitation coil for an electrodeless fluorescent lamp of the type having a core of insulating material, is made of a metal having a low thermal expansion coefficient which is plated with a high-conductivity metal. An insulating coating is applied over the metal plating. An exemplary coil includes a molybdenum wire, plated with silver, and finally coated with alumina. The result is a thermally stable excitation coil that maintains its shape, even at high operating temperatures, and hence maintains its impedance characteristic over the operating range of the lamp.

12 Claims, 2 Drawing Sheets

EXCITATION COIL FOR AN ELECTRODELESS FLUORESCENT LAMP

FIELD OF THE INVENTION

The present invention relates generally to electrodeless fluorescent lamps and, more particularly, to an improved excitation coil therefor which maintains its shape, and hence its impedance characteristic, even over prolonged usage.

BACKGROUND OF THE INVENTION

Typical excitation coils for electrodeless fluorescent lamps, such as copper solenoidal air-core coils, overheat at the relatively high operating temperature thereof and become distorted. Moreover, at high temperature, copper anneals so that, upon cooling, it does not revert to its original shape, but remains distorted. Such distortion changes the impedance characteristic at the operating frequency of the lamp (e.g., a few megahertz), rendering the power circuit out of tune. Further lamp operation causes further distortion of the coil, often resulting in short circuits between turns.

Accordingly, it is desirable to provide an improved excitation coil for an electrodeless fluorescent lamp which maintains its shape and hence its impedance characteristic.

SUMMARY OF THE INVENTION

An excitation coil for an electrodeless fluorescent lamp of the type having a core of insulating material, comprises a metal having a low thermal expansion coefficient which is plated with a high-conductivity metal. Preferably, an insulating coating is applied over the metal plating. One preferred coil comprises molybdenum, plated with silver, and finally coated with alumina. The result is a thermally stable excitation coil that maintains its shape, even at high lamp operating temperatures, and hence maintains its impedance characteristic over the operating range of the lamp.

BRIEF DESCRIPTION OF THE DRAWINGS

The features and advantages of the present invention will become apparent from the following detailed description of the invention when read with the accompanying drawings in which.

DETAILED DESCRIPTION OF THE INVENTION

Figure 1A:
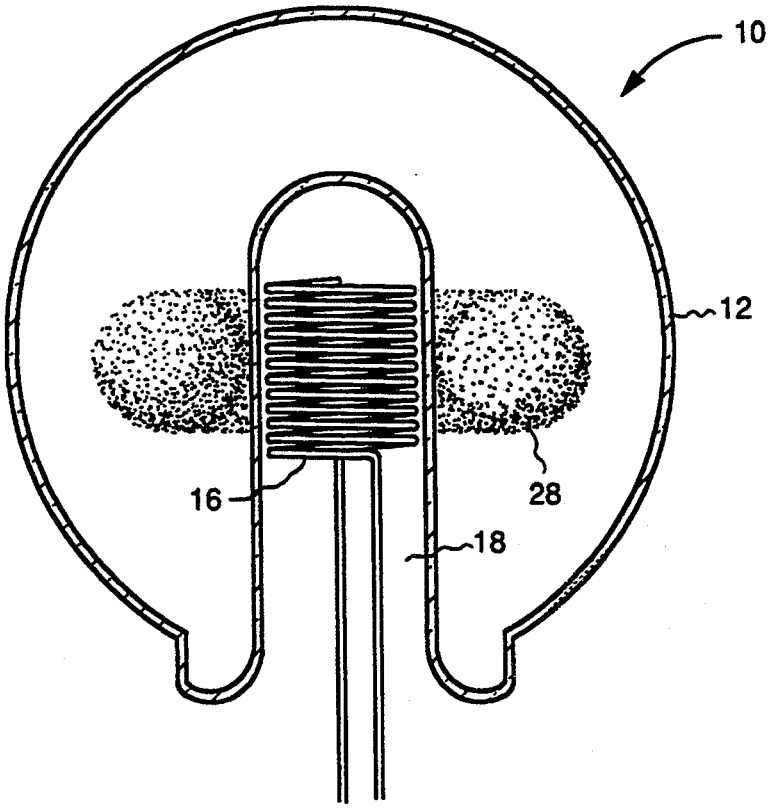
FIG. 1A illustrates an electrodeless fluorescent lamp having an improved excitation coil in accordance with the present invention.

FIG. 1A illustrates a typical electrodeless fluorescent lamp 10 having a spherical bulb or envelope 12 containing an ionizable gaseous fill. A suitable fill, for example, comprises a mixture of a rare gas (e.g., krypton and/or argon) and mercury vapor and/or cadmium vapor. An excitation coil 16 is situated within, and removable from, a re-entrant cavity 18 within envelope 12. The interior surfaces of envelope 12 are coated in well-known fashion with a suitable phosphor which is stimulated to emit visible radiation upon absorption of ultraviolet radiation. Envelope 12 fits into one end of a base assembly (not shown) containing a radio frequency power supply with a standard (e.g., Edison type) lamp base at the other end.

Figure 1B:
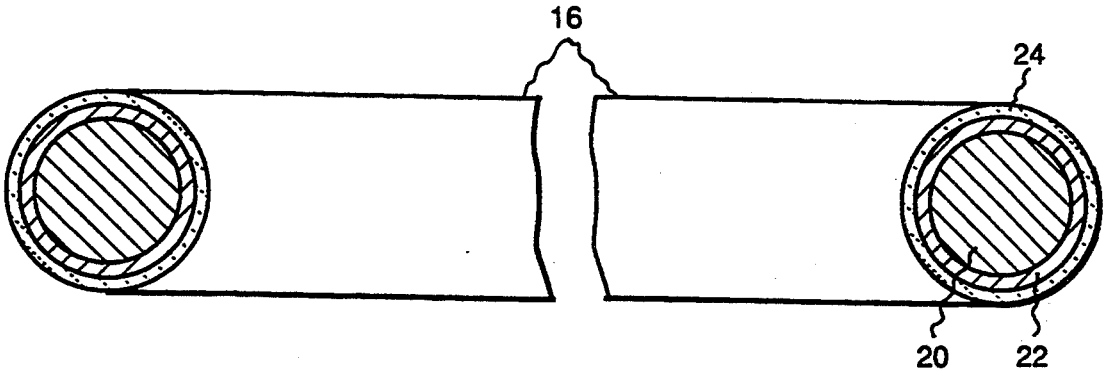
FIG. 1B is a cross sectional view of the excitation coil of the lamp of FIG. 1A.

In accordance with the present invention, as illustrated in FIG. 1B, coil 16 is comprised of a metal 20 having a low thermal expansion coefficient which provides thermal stability to the coil, such that the coil maintains its shape under operating temperatures, typically in the range from about 50° C. to 300° C., depending on the power input to the coil. Preferably, metal 20 also has a relatively high thermal conductivity.

A suitable metal 20 having a low thermal expansion coefficient typically has a relatively high resistivity (i.e., higher than that of copper). However, since RF currents in the coil flow mainly on the surface of the coil, the resistive losses may be minimized by plating metal 20 with a metal 22 of high conductivity (i.e., low resistivity). At a typical operating frequency of an electrodeless fluorescent lamp (e.g., on the order of an few megahertz), a suitable plating metal 22 may be approximately 1 mil thick.

Preferably, excitation coil 16 according to the present invention further includes an insulating coating 24 applied to the plated metal. Such an insulating coating may comprise, for example, a ceramic applied to the metal plating by plasma spraying in a well-known manner. The insulating coating provides additional insulation so as to further avoid short circuits between turns of the coil.

According to a preferred embodiment, metal 20 comprises molybdenum, metal plating 22 comprises silver, and insulating coating 24 comprises alumina. The coefficient of thermal expansion of molybdenum is $4.9\times10^{-6}$° K., and the thermal conductivity of molybdenum is 142 Watts/meter/°K. For this embodiment, metal plating 22 serves another function in addition to providing a low resistivity. In particular, metal plating 22 suppresses formation of a noxious oxide when molybdenum is heated. Insulating coating 24 further isolates the molybdenum from air, further suppressing oxide formation.

Other suitable metals 20 have a coefficient of thermal expansion in the range 4.6 to $7.3\times10^{-6}$° K., such as, for example, neodymium, chromium, iridium, niobium, rhenium, tantalum, and zirconium. Such metals have thermal conductivities in the range 88 to 54 Watts/m/°K.

Other suitable plating metals include gold, platinum, paladium, iridium and rhodium.

Other suitable ceramic coatings include beryllium oxide (BeO), zirconium oxide ($ZrO_2$), yttrium oxide ($Y_2O_3$), scandium oxide ($Sc_2O_3$), hafnium oxide ($HfO_2$), and lanthanum oxide ($La_2O_3$).

In operation, as shown in FIG. 1A current flows through winding 16, establishing a radio frequency magnetic field thereabout. The magnetic field induces an electric field within envelope 12 which ionizes and excites the gas contained therein, resulting in a discharge 28. Ultraviolet radiation from discharge 28 is absorbed by the phosphor coating on the interior surface of the envelope, thereby stimulating the emission of visible radiation by the lamp envelope.

Figure 2:
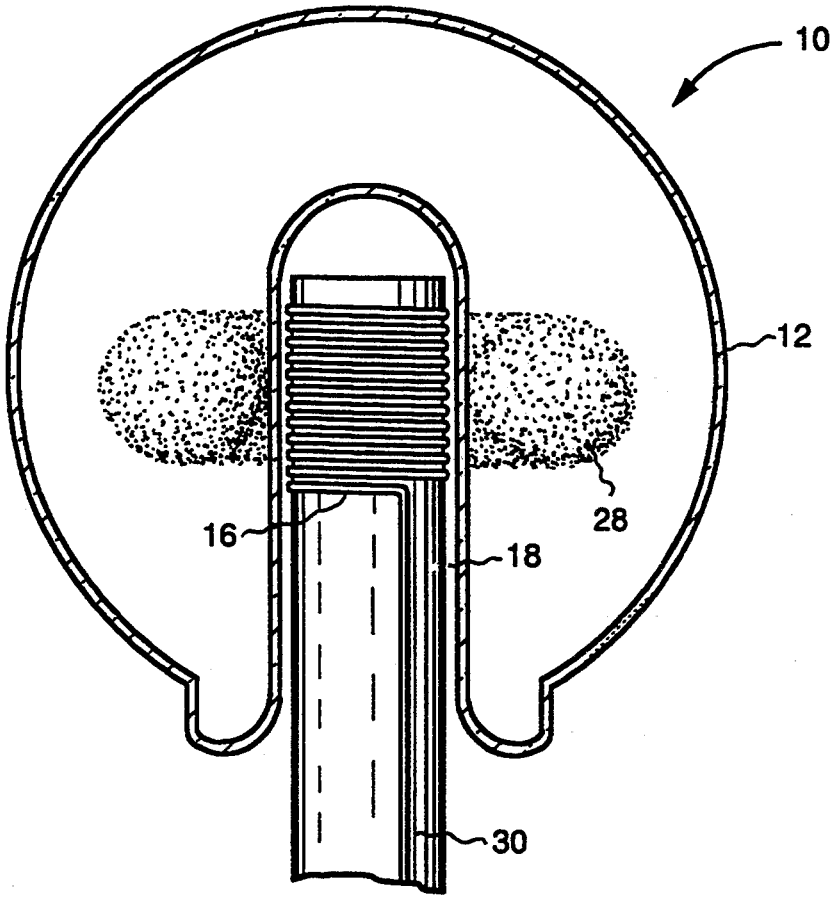
FIG. 2 illustrates an electrodeless fluorescent lamp having an improved excitation coil in accordance with an alternative embodiment of the present invention.

In an alternative embodiment of the present invention, as shown in FIG. 2, coil 16 is wound about an insulating core 30 comprised of, for example, a Teflon synthetic resin polymer. (The elements numbered 10, 12, 18 and 28 refer to the same elements described with reference to FIG. 1.)

In another alternative embodiment (not shown), the effective coil resistance is minimized by using a larger coil surface area in lieu of, or in addition to, metal plating 22. For example, a suitable coil may comprise a molybdenum wire of relatively large diameter (e.g., in the range from about 40 to 70 mils) coated with alumina.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

We claim:

1. An electrodeless fluorescent lamp, comprising:

a light-transmissive envelope containing an ionizable, gaseous fill for sustaining an arc discharge when subjected to a radio frequency magnetic field and for emitting ultraviolet radiation as a result thereof, said envelope having an interior phosphor coating for emitting visible radiation when excited by said ultraviolet radiation, said envelope having a slope so as to define a re-entrant cavity portion therein;

an excitation coil removably contained within said re-entrant cavity portion, said excitation coil comprising a first metal of sufficiently low thermal conductivity so as to avoid deformation of said coil due to heating during lamp operation, said excitation coil further having a metal plating of low resistivity disposed over said first metal and an insulating coating disposed over said metal plating, said metal plating being sufficiently thick to carry a radio frequency current in said excitation coil, thereby providing said radio frequency magnetic field while avoiding high resistive losses in said excitation coil.

2. The lamp of claim 1 wherein said first metal comprises molybdenum, said metal plating comprises silver, and said insulating coating comprises silver, and said insulating coating comprises alumina.

3. The lamp of claim 1 wherein said first metal has a coefficient of thermal expansion in the range from approximately 4.6 to $7.3\times10^{-6}$° K.

4. The lamp of claim 3 wherein said first metal has a thermal conductivity in the range from approximately 88 to 54 W/m/°K.

5. The lamp of claim 1 wherein said first metal is selected from the group consisting of molybdenum, neodymium, chromium, iridium, niobium, rhenium, tantalum, and zirconium.

6. The lamp of claim 1 wherein said metal plating comprises a metal selected from the group consisting of silver, gold, platinum, paladium, iridium, and rhodium.

7. The lamp of claim 1 wherein said insulating coating comprises a ceramic.

8. The lamp of claim 7 wherein said insulating coating is selected from the group consisting of alumina, beryllium oxide, zirconium oxide, yttrium oxide, scandium oxide, hafnium oxide, and lanthanum oxide.

9. The lamp of claim 1 wherein said first metal comprises molybdenum, said metal plating comprises silver, and said insulating coating comprises alumina.

10. The lamp of claim 1 wherein said excitation coil is wound about an insulating core, said insulating core being disposed in said re-entrant cavity portion.

11. The lamp of claim 10 wherein said insulating core comprises a Teflon synthetic resin polymer.

12. The lamp of claim 1 wherein said excitation coil is solenoidal in shape.

* * * * *